United States Patent [19]

Oberndorfer et al.

[11] Patent Number: 4,625,191

[45] Date of Patent: Nov. 25, 1986

[54] SAFETY ELECTROMAGNETIC RELAY

[75] Inventors: Johannes Oberndorfer, Hofsingelding, Fed. Rep. of Germany; Kenji Ono, Osaka; Yoshiyuki Iwami, Obihiro, both of Japan

[73] Assignee: Matsushita Electric Works, Ltd., Osaka, Japan

[21] Appl. No.: 754,306

[22] Filed: Jul. 12, 1985

[30] Foreign Application Priority Data

Jul. 13, 1984 [DE] Fed. Rep. of Germany ..... 3425889

[51] Int. Cl.[4] ..... H01H 67/02

[52] U.S. Cl. ..... 335/78; 335/106; 335/125; 335/121; 335/122; 335/129; 335/200

[58] Field of Search ..... 335/78, 80, 81, 83, 335/84, 85, 106, 121, 128, 129, 125, 200

[56] References Cited

U.S. PATENT DOCUMENTS

| | | | |
|---|---|---|---|
| 3,270,301 | 8/1966 | Bengtsson | 335/129 |
| 3,993,971 | 11/1976 | Ono et al. | 335/78 |
| 4,539,540 | 9/1985 | Kimpel et al. | 335/78 |

FOREIGN PATENT DOCUMENTS

| | | |
|---|---|---|
| 7512499 | 3/1977 | Fed. Rep. of Germany . |
| 2902885 | 3/1983 | Fed. Rep. of Germany . |

*Primary Examiner*—E. A. Goldberg

*Assistant Examiner*—Lincoln Donovan

*Attorney, Agent, or Firm*—Schwartz, Jeffery, Schwaab, Mack, Blumenthal & Evans

[57] ABSTRACT

A safety electromagnetic relay includes two pairs of contact sets, each pair including a load-driving contact set and a control contact set, and each contact set including a fixed contact and a movable contact spring. The two load-driving contact sets are normally-open contacts and may be connected in series and included in an external load circuit which requires safe interruption. The contact springs of each of the first and second pairs are ganged by a coupling member which is movable independently of a relay armature. The ganged pairs of contact springs are actuated by the armature in such a manner that when one of the load-driving contact sets should become welded in the closed condition, the other load-driving contact set will still open when the armature moves to the inoperative position, but the control contact set associated with the welded load-driving contact set is prevented from returning to its condition corresponding to the inoperative position of the armature. The status of the control contact set may be utilized to signalize failure of the relay. Specifically, the control contact set may be a normally-closed contact which, when the associates load-driving contact set has welded, is retained in its open condition, thereby preventing recharging of a capacitor that may be required for re-energization of the relay coil.

14 Claims, 20 Drawing Figures

SAFETY ELECTROMAGNETIC RELAY

BACKGROUND OF THE INVENTION

Safety relays are used for the purpose of safely breaking a circuit, for instance the power supply circuit of presses, machine tools, furnaces or medical appliances To this end, prior art installations employ independent contact sets connected in series, which contact sets are normally-open contacts of two independent monostable relays. In case one of the contact sets does not open, for instance due to contact welding, the circuit will still be broken by the other series-connected contact set of the second relay The safety may be increased by connecting more than two contact sets in series, although it is regularly assumed that the same error does not simultaneously occur at two contacts.

For recognizing a failure, each of the known safety relays is provided with a control contact set which is ganged to the load-driving contact set to indicate the position of the load-driving contact set irrespective of the position of the relay armature. The control contact sets of both relays are usually inserted in a control or evaluating circuit in such a manner that a renewed closure of the load circuit is prevented in case one of the load-driving contact sets has become welded. The condition of the control contact sets may be evaluated by means of a capacitor which, in the inoperative position of one relay, is charged via the control contact set operated as a normally-closed contact, the charge being required for switching the respective other relay to its operative position. In more sophisticated control circuits, there is an increasing tendency to employ microprocessors for evaluating the condition of the control contact sets.

Known safety relays usually include further contact sets which serve as holding contacts and as contacts in a signalling circuit for supervising the function of the system. All these contact sets (load-driving, control, holding and signalling contact sets) are regularly ganged and actuated in common by the relay armature.

SUMMARY OF THE INVENTION

It is an object of the invention to provide an electromagnetic relay which can be used, as a single relay, to replace the previously required two relays, yet achieving the same safety with respect to breaking of a load circuit and recognition of contact failure, thereby reducing the overall space requirement, power consumption and circuit expenditure of the system.

To meet with this object, an electromagnetic relay according to the present invention comprises an excitation coil; an armature adapted for movement in opposite directions between an operative and an inoperative position in response to energization and de-energization of the coil; first and second pairs of contact sets, each pair including a load-driving contact set and a control contact set, each contact set having a fixed contact and a movable contact, the movable contacts of one contact set in each of the first and second pairs being adapted to be positively displaced by the armature against resilient forces when the armature moves in one direction and to return due to said resilient forces when the armature moves in the other direction; and first coupling means ganging the movable contacts of the first pairs of contact sets and second coupling means ganging the movable contacts of the second pair of contact sets, each coupling means being movable independently of the armature at least when the latter moves from its operative position, in which the load-driving contact sets are closed, to its inoperative position.

The invention is based on the finding that, for the safety of circuit breaking and failure recognition, it is only important that the control contact set is ganged with the associated load-driving contact set, but unnecessary that both the load-driving contact set and the control contact set be positively actuated by the armature. By employing coupling means which gang the control contact set to the associated load-driving contact set of each pair of contact sets and which are movable independently of the armature, it becomes possible to control two load-driving contact sets, which in the prior art require two independent relays, by the same armature of one single relay. In this manner, if one of the load-driving contact sets is prevented from opening due to contact welding, when the relay is deenergized, the control contact set, which is ganged to this welded load-driving contact set by the respective coupling means, is retained in its operative condition, whereas the relay armature is retained movable independently of this coupling means and will operate to open the other load-driving contact set.

DESCRIPTION OF PREFERRED EMBODIMENT

Figure 1:
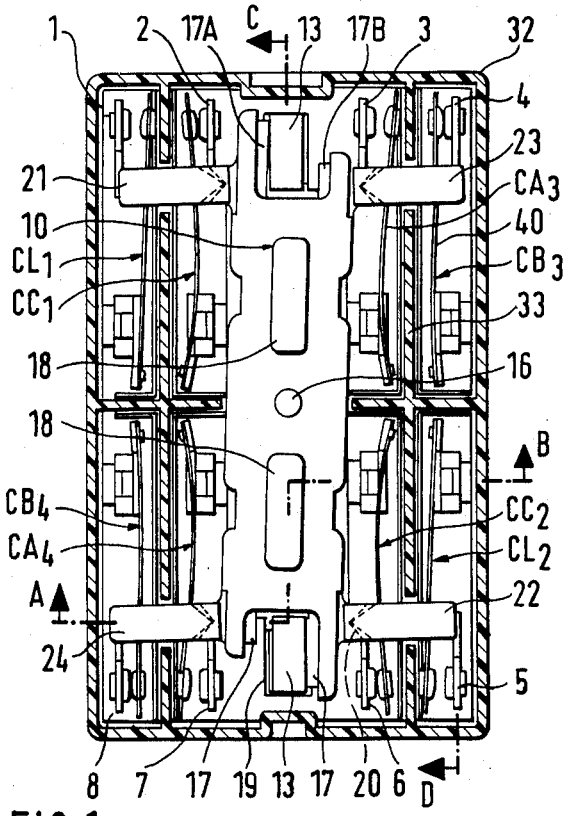
FIG. 1 is a top view, partly in section, of an electromagnetic relay in accordance with a first embodiment of the present invention.
Figure 3:
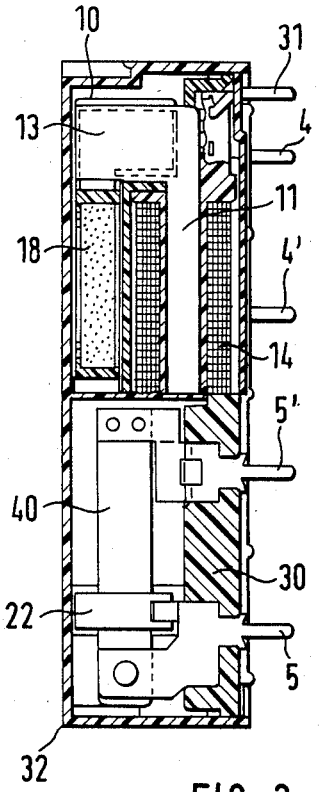
FIG. 3 is a cross section taken on line C-D of FIG. 1.
Figure 2:
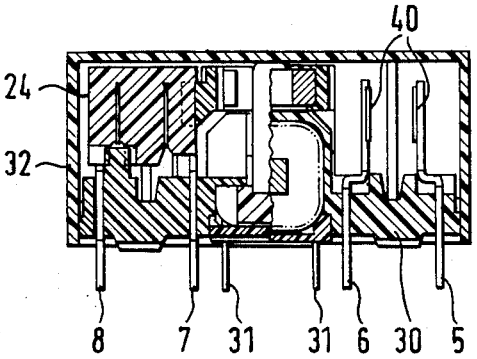
FIG. 2 is a cross section taken on line A-B of FIG. 1.
Figure 4:
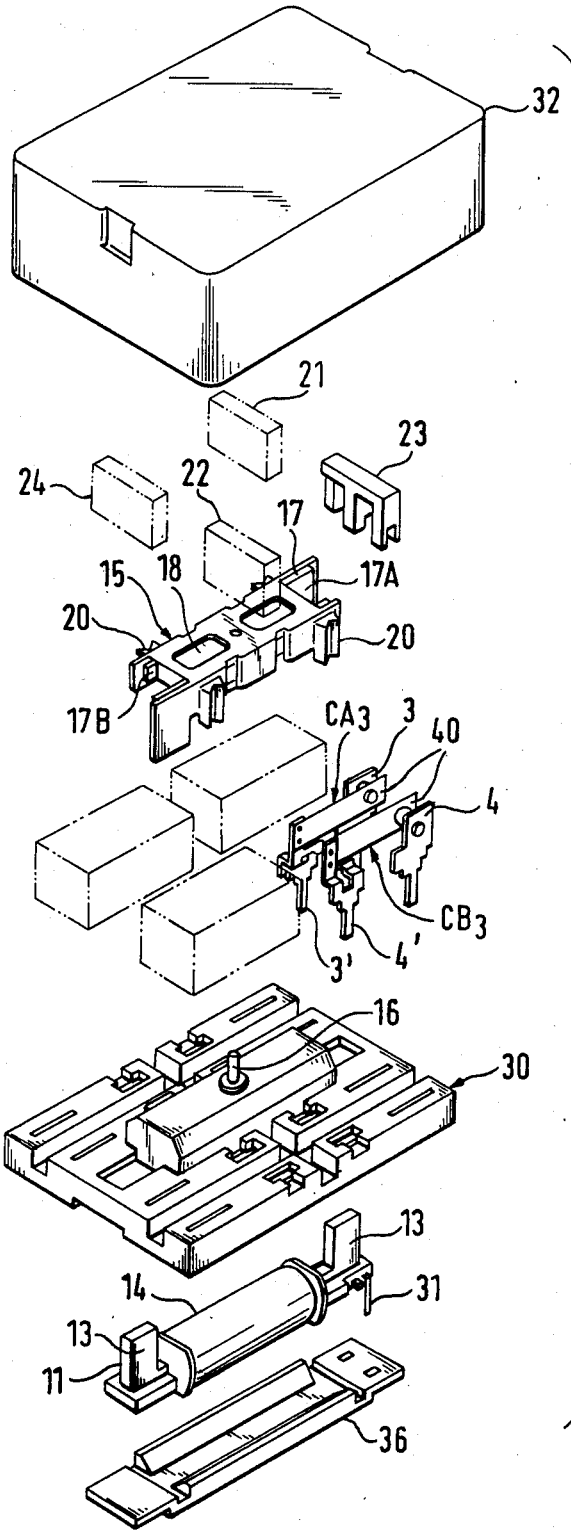
FIG. 4 is an exploded perspective view of the above relay.

In the drawings, FIGS. 1 to 4 show an electromagnetic relay in accordance with a preferred embodiment of the present invention. The relay has a contact arrangement with four sets of normally-closed contacts and four sets of normally-open contacts, all the contacts being actuated by a single electromagnet device 10. The electromagnet device 10 comprises a U-shaped yoke 11 mounted together with a bracket 36 on the center portion of a base 30, an excitation coil 14 wound around the center leg of the yoke 11, and an elongated armature 15 which overlies the yoke 11 to be pivotally supported on the base 30 so as to be rotatable about a pivot pin 16 within a plane parallel to the plane of the base 30. The armature 15 comprises permanent magnets 18 interposed between a pair of pole plates 17 the longitudinal ends of which are in staggered relation with each other, and a plastic molding covering the above assembly except the longitudinal end portions thereof to combine the assembly into a unitary structure. The permanent magnets 18 are magnetized in a direction perpendicular to the longitudinal axis of the pole plates 17 so that the pole plates are of opposite polarity. The yoke 11 is magnetically coupled with the armature 15 with its side legs 13 extending respectively into the gaps between the exposed longitudinal ends of the pole plates 17. Each pole plate 17 has a wider face 17A at its one longitudinal end than at the other end, the wider face 17A of one pole plate being disposed on the opposite side of the side leg 13 from the narrower face 17B of the other pole plate so that, when the excitation coil 14 is deenergized, the armature 15 is moved into the position with the wider faces 17A of the armature 15 being attracted toward the side legs 13 by the action of magnetic flux from the permanent magnets 18 and is stable at this position. When the excitation coil 14 receives a current of given direction, the armature 15 is driven to rotate against the magnetic flux from the permanent magnets 18 into an operative position. Upon interruption of the current, the armature 15 rotates in the opposite direction by the magnetic force of the permanent magnets 18 to return into the inoperative or stable position. Residual plates 19 are provided on both sides of each side leg 13 facing the pole ends of the pole plates 17 for enhancing the sensitivity of response of the armature 15.

Figure 15:
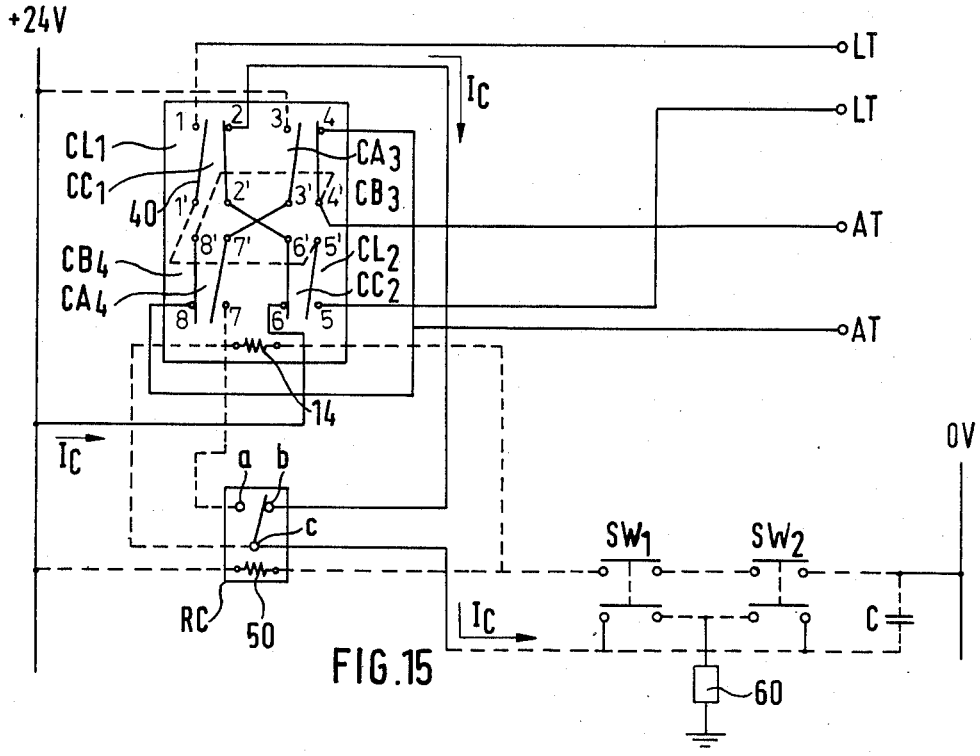
FIGS. 15 to 17 are circuit diagrams, respectively showing one application of the above relay.
Figure 16:
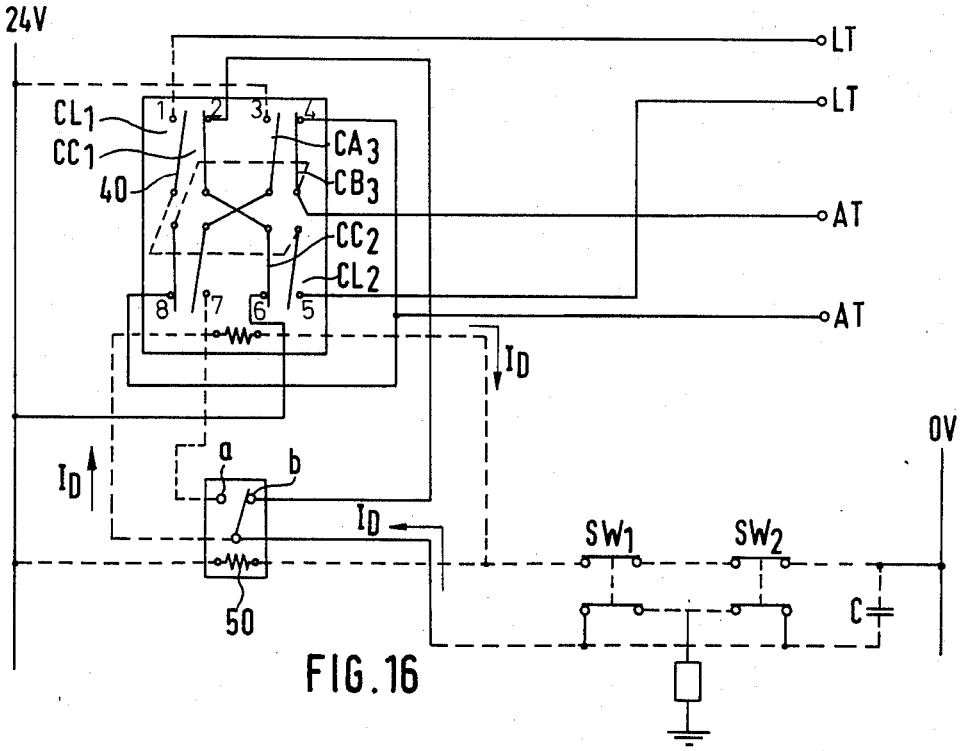
Figure 17:
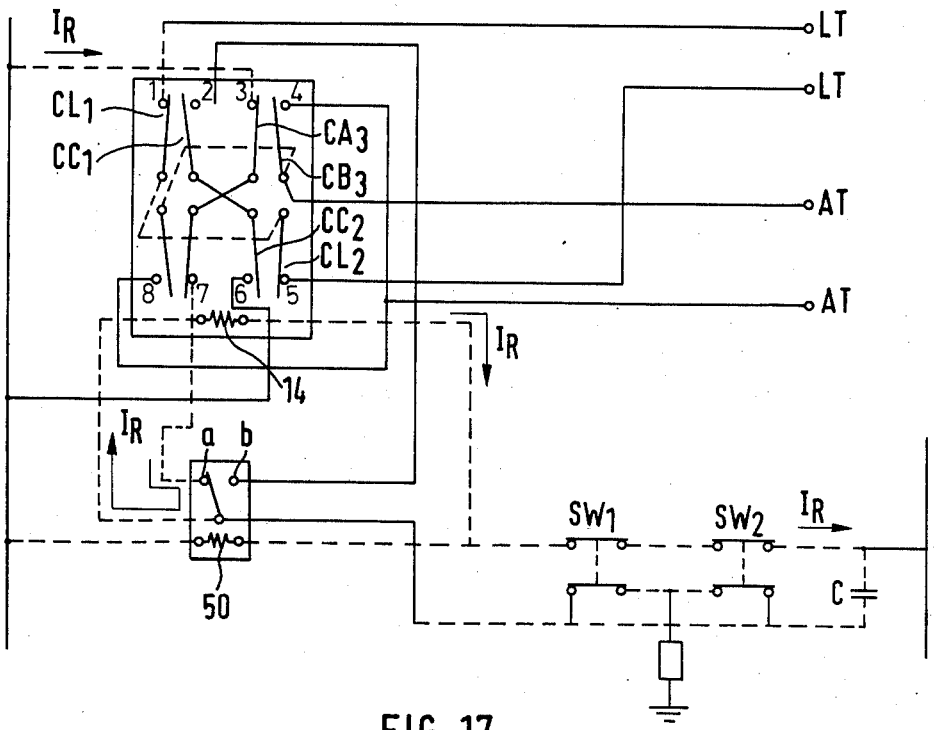
Figure 18:
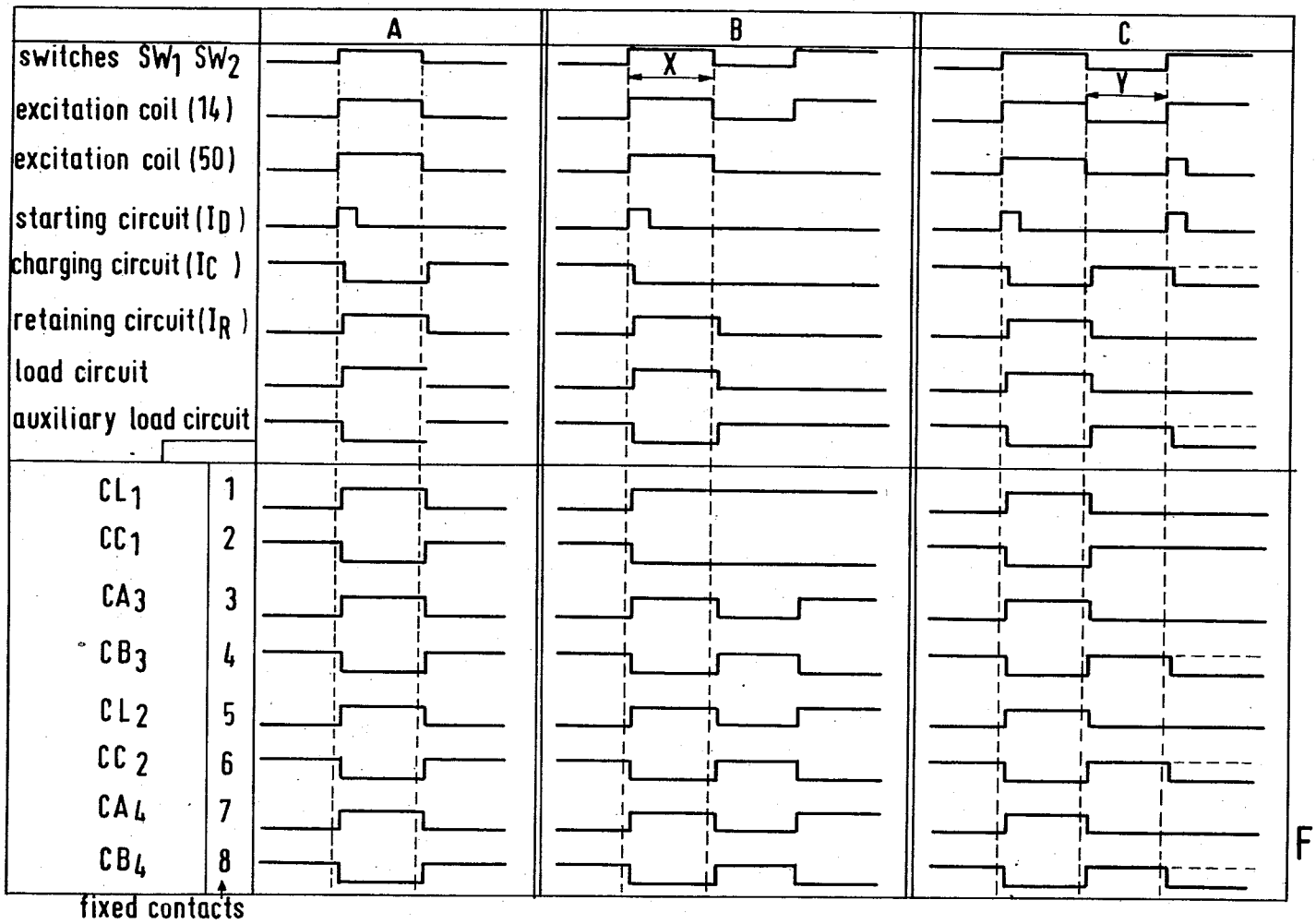
FIG. 18 is a time-chart representation showing the functions of the several points in the circuit of FIGS. 15 to 17.

Four sets of composite contact assemblies are positioned on both sides of the electromagnet device 10 with two sets being located on the longitudinal ends thereof and are actuated respectively by means of four cards 21, 22, 23, 24 which cooperate with corresponding actuator sections 20 formed on both sides of the armature 15 at its longitudinal ends, these composite contact assemblies being disposed symmetrically with respect to two axes intersecting in the pivot pin 16. Each of the composite contact assemblies consists of a normally-open contact set and a normally-closed contact set each comprising a fixed contact and a movable spring 40. Two movable springs constituting one contact assembly are mechanically coupled by a single card and operatively connected to the armature thereby so as to be actuated concurrently in response to the armature movement. The fixed contacts 1, 2, 3, 4, 5, 6, 7, 8 are held on respective terminals extending through the base 30, while the movable springs 40 are fixed at their one end respectively to external terminals 1', 2', 3', 4', 5', 6', 7', 8' extending through the base 30 in the center portion thereof. Thus, a pair of normally-open or closed contact sets, which are in a point symmetry relation with each other about the pivot pin 16, can be easily connected in series by wiring between two external terminals in point symmetry relation. Numeral 31 indicates coil terminals connected to said excitation coil 14. In the present embodiment, one of the two composite contact assemblies disposed on a diagonal line has its normally-open contact sets being utilized as a first load-driving contact set $CL_1$ and has its normally-closed contact sets as a first control contact sets $CC_1$, while the other composite contact assembly has its normally-open contact set being utilized as a second load-driving contact set $CL_2$ and has its normally-closed contact set as a second control contact set $CC_2$. As shown in FIGS. 15 to 17, the relay of the above construction is utilized by connecting the fixed contacts 1 and 5 of the first load-driving contact set $CL_1$ and second load-driving contact set $CL_2$ to a load by the use of load terminals LT. One of the remaining two composite contact assemblies which are disposed on the other diagonal line are utilized to serve as a third normally-open auxiliary contact set $CA_3$ a third normally-closed auxiliary contact set $CB_3$, while the other composite contact assembly are utilized to serve as a fourth normally-open contact set $CA_4$ and a fourth normally-closed auxiliary contact set $CB_4$.

As shown in FIGS. 7 to 12, each of the cards 21, 22, 23, 24 is formed with a pair of parallel slits 25, 26 through which said movable springs 40 extend to be mechanically coupled at positions offset toward the fixed ends from the respective contact faces for associated movement with each other. Each of the cards 21, 22, 23, 24 is formed at its end with a steep projection 27 which extends into the complementary actuator section 20 in the form of a V-shaped recess to provide a bearing between each card and the armature 15 so that, when the armature 15 in response to the energization of the excitation coil 14 moves into the operative position, the cards 21 and 22 are pushed outwardly to urge the movable springs 40 outwardly for the concurrent contact switching actions thereof. At this time, the remaining cards 23 and 24 are urged inwardly by the restoring forces of the inwardly returning movable springs 40 coupled by the cards 23 and 24. When the armature 15 returns to the inoperative or stable position upon deenergization of the electromagnet device 10, the pairs of movable springs 40 respectively coupled by the cards 21 and 22 return inwardly and urge those cards 21 and 22 inwardly to reverse the contacts, at which occurrence the cards 23 and 24 are pushed outwardly to urge the cooperative movable springs 40 for desired contact switching actions. Each slit 25,26 is dimensioned to have a width slightly greater than the thickness of the movable spring 40 and is formed on its either sidewall with a knife-edged fulcrum which engages the movable spring at optimum position for transferring the force between the movable spring and the card. That is, the adjacently disposed movable springs 40 extend through one single card to be coupled thereby and are in turn operatively connected to the armature 15 with the steep projection 27 releasably engaging the actuator section 20 so that the force can be transmitted from the armature 15 moving into the operative position to the cards 21 and 22 for pushing outwardly the same, while no force is transmitted to the cards 21 and 22 from the armature 15 moving into the inoperative position, so as to allow the cards 21 and 22 to return to the initial positions only by the restoring forces of the cooperative movable springs 40.

Figure 5:
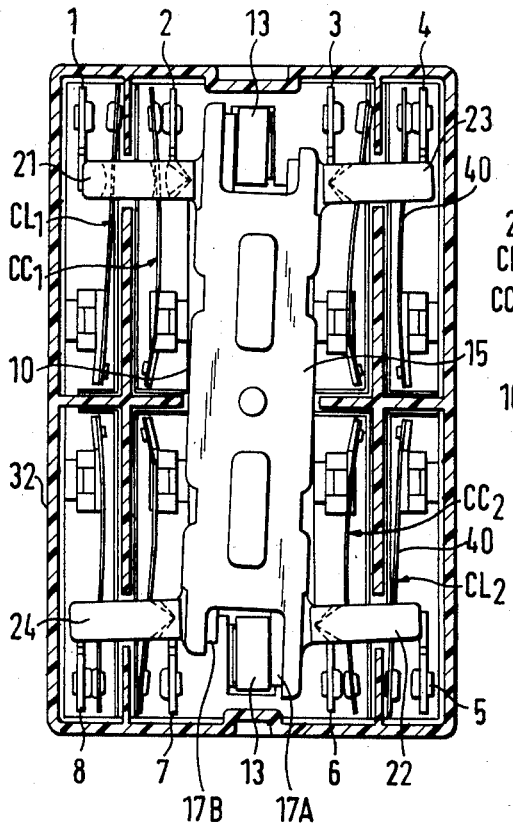
FIG. 5 is a top view of the above relay with the armature being in the inoperative position under normal condition.
Figure 6:
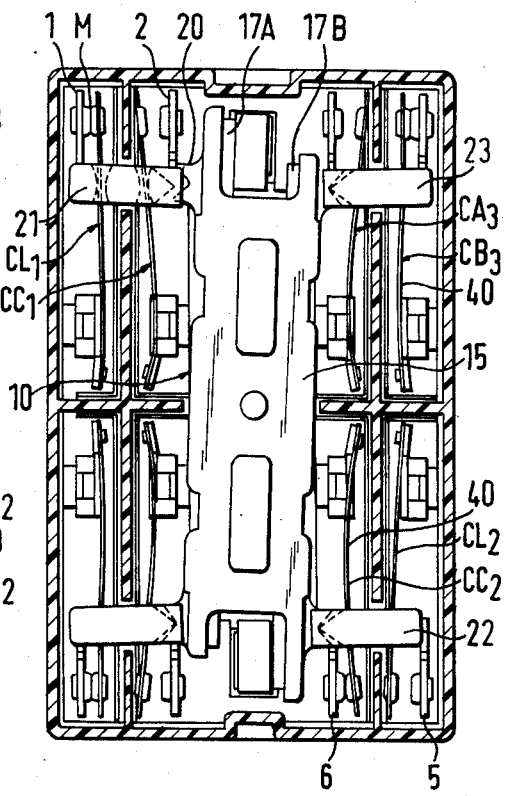
FIG. 6 is a top view of the above relay with the armature having returned to the inoperative position after the first load-driving contact set causes the contact welding.
Figure 7:
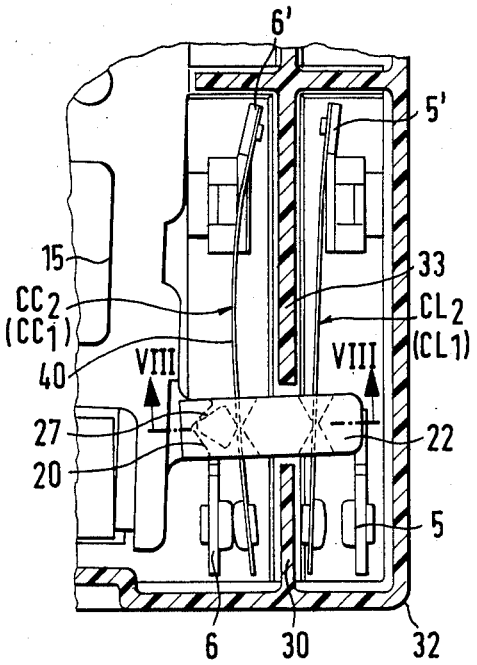
FIG. 7 is a partial top view of the above relay showing the second load-driving contact set and the second control contact set under the normal condition at the time of the relay being deenergized.
Figure 9:
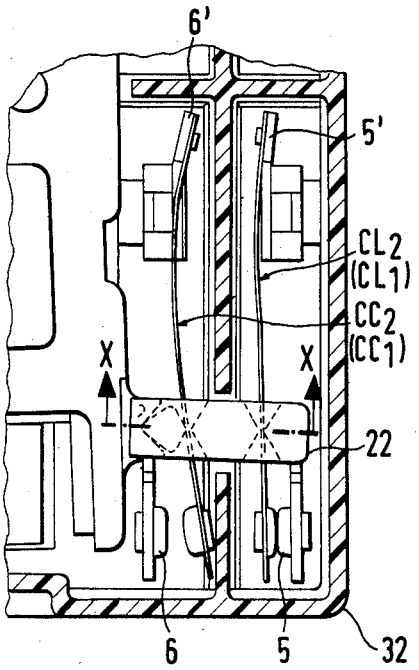
FIG. 9 is a partial top view showing the same portion of the relay as shown in FIG. 7 but showing the portion under normal condition at the time of the relay being energized.
Figure 8:
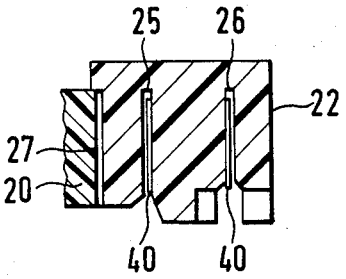
FIG. 8 is a cross section taken on line 8—8 of FIG. 7.
Figure 10:
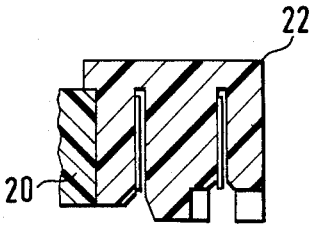
FIG. 10 is a cross section taken on line 10—10 of FIG. 9.
Figure 13:
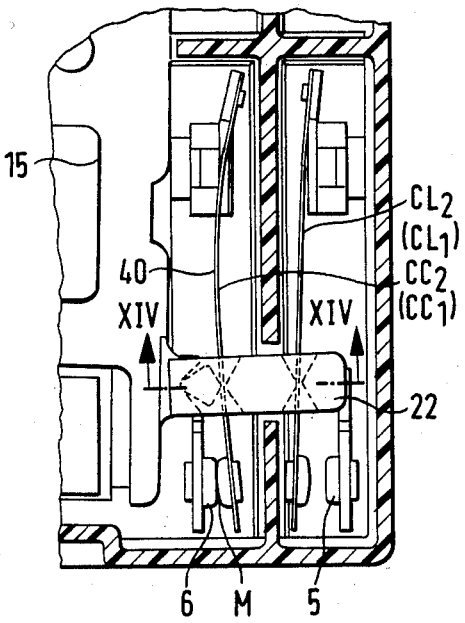
FIG. 13 is a partial top view of the above relay showing the same portion as in FIG. 7 at the time of the relay being energized after the control contact set caused the contact welding.
Figure 11:
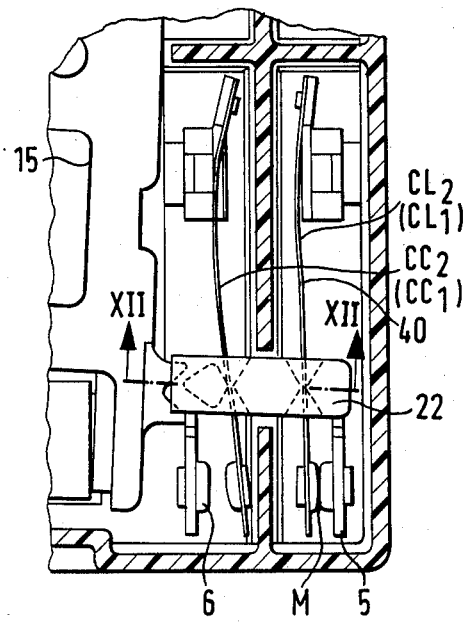
FIG. 11 is a partial top view of the above relay showing the same portion as in FIG. 7 at the time of the relay being deenergized after the load-driving contact set caused the contact welding.
Figure 14:
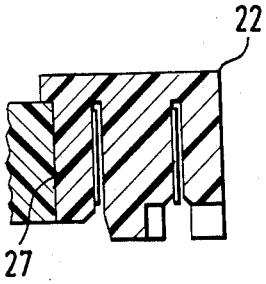
FIG. 14 is a cross section taken on line 14—14 of FIG. 13.
Figure 12:
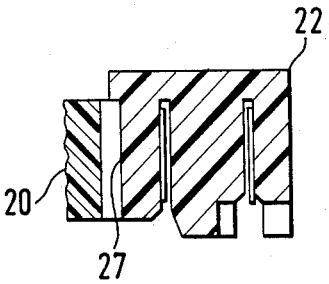
FIG. 12 is a cross section taken on line 12—12 of FIG. 11.

The pair of movable springs constituting the first load-driving contact set $CL_1$ and the first control contact set $CC_1$ are operatively connected to the armature 15 by means of the first card 21 in such a way that, when one of the movable springs is restricted in its displacement by some external reason, the other movable spring is also restricted in its displacement to thereby inhibit its contact switching action. Also, the pair of movable springs 40 constituting the second load-driving contact set $CL_2$ and second control contact set $CC_2$ are connected in the same manner to the armature 15 by means of the card 22. In other words, each of the movable springs 40 is adjusted to perform the desired contact switching action in response to being urged or flexed by a predetermined amount. That is, any insufficiency in the displacement of one of the movable springs in a pair will safely prevent the contact switching action of the other irrespective of whether the armature 15 moves into the operative or inoperative position FIGS. 5 and 7 to 10 explain the behaviors of the second load-driving contact set $CL_2$ and the second control contact set $CC_2$ under the normal condition. FIGS. 5, 7 and 8 show the condition when the armature 15 is in the inoperative position, and FIGS. 9 and 10 show the same when the armature 15 is in the operative position FIGS. 6, 11 and 12 show the case in which the armature 15 returns to the inoperative position in response to the deenergization of the coil when the second (or first) load-driving contact set $CL_2(CL_1)$ suffers from contact welding. In the latter case where the outer movable spring 40 undergoes contact welding at M with the complementary fixed contact and is thus restricted in its displacement, the inner movable spring 40 is associatedly restricted in its displacement, inhibiting its contact switching action. At this occurrence, the card 22 although tending to move inwardly to a certain extent in flexing the outer movable spring 40 will be retained thereby in a spaced relation with the armature 15, as apparent from FIG. 11, ensuring to keep the inner movable spring 40 apart from the complementary fixed contact. When, on the other hand, the armature 15 in response to the energization of the excitation coil moves into the operative position with the inner movable spring 40 of the second (or first) control contact set $CC_2$ ($CC_1$) being welded at M to the complementary fixed contact , thus restricting the displacement of the inner movable spring 40, as shown in FIGS. 13 and 14, the outer movable spring 40 is correspondingly restricted in its displacement, thereby preventing its contact switching action.

The terminals leading to said contact sets extend sealingly through the base 30, on which a plastic cover 32 is fitted to form therebetween a sealed space for accommodating the said electromagnet device 10 and contact sets, thus protecting the internal structure from the ambient atmosphere and therefore assuring proper contact switching action against external dust and moisture. Projecting inwardly of the cover 32 are a plurality of partitions 33 which project between the adjacent movable springs 40 in each pair without interfering with the spring motions, for the purpose of elongating the creepage distance of insulation, in addition to preventing any connection of one movable spring when broken with the other spring, and further preventing the entry of the harmful gas of metallic oxide resulting from possible arc caused at the instance of contact release of one contact set, particularly the load-driving contact set, which carries a larger current, into the other contact set (control contact set). As will be apparent from the figures, the movable springs of said normally-open contact sets are actuated in a lift-off manner, while those of said normally-closed contact sets are actuated in a flexure manner.

Next, the preferred application and the operation of the electromagnetic relay will be explained with reference to FIGS. 15 to 18. The electromagnetic relay is employed for driving a load such as a processing machine which is required to be shut off from its power source promptly and safely for a safe guard purpose. For this purpose, the normally-open contact sets are connected in series with the load in order that one of the normally-open contact sets can securely act to shut off the load even when the other fails to interrupt the circuit. As shown in FIGS. 15 to 17, the relay forms the circuit together with a control relay RC, a series combination of switches $SW_1$ and $SW_2$, and a capacitor C, wherein the first and second load-driving contact sets $CL_1$ and $CL_2$ are connected to load terminals LT to form a load-driving circuit. That is, the first and second load-driving contacts sets $CL_1$ and $CL_2$ are connected in series with the load by coupling together the external terminals 1' and 5' of the first and second load-driving contact sets $CL_1$ and $CL_2$ and coupling the fixed contacts 1 and 5 of the first and load-driving contact sets $CL_1$ and $CL_2$ respectively to the load terminals LT. The capacitor C is incorporated to supply an exciting current to the excitation coil 14 of the electromagnet device 10 at the time of starting, and for this purpose is connected in series with the first and second control contact sets $CC_1$ and $CC_2$, the normally-closed contact (b) of the control relay RC between the power line and ground line, thus forming a charging circuit. The charging circuit sees a charging current $I_C$ when the electromagnet device 10 is in the deenergized condition, which charging current $I_C$ as indicated by arrows in FIG. 15 flowing through the first and second normally-closed control contact sets $CC_1$ and $CC_2$, the normally-closed contact (b) of the control relay RC into the capacitor C to charge the same. The capacitor C also forms a starting circuit with the switches $SW_1$ and $SW_2$, the excitation coil 14, and the common terminal (c) of the control relay RC. The starting circuit, upon closing the switches $SW_1$ and $SW_2$, completes to deliver a discharge current $I_D$ as indicated by arrows in FIG. 16 from the capacitor C through the control relay RC and the excitation coil 14, moving the armature 15 into the operative position to reverse the contact sets at a time, whereby the first and second load-driving contact sets $CL_1$ and $CL_2$ are closed to drive the load. Additionally, the switches $SW_1$ and $SW_2$ are inserted in series with the excitation coil 50 of the control relay RC between the power line and ground line so that the control relay RC is reversed to close its normally open contact (a) at the time the switches $SW_1$ and $SW_2$ are turned on. That normally-open contact (a) is connected to the power line through the fixed contacts 7 and 3 of the respective fourth and third normally-open auxiliary contact sets $CA_4$ and $CA_3$ in order to form a retaining circuit after the switches $SW_1$ and $SW_2$ are turned on to reverse the contact sets, at which instance, the retaining circuit causes a retaining current $I_R$ as indicated by arrows in FIG. 17 to start flowing from the power line through the third and fourth normally-open auxiliary contact sets $CA_3$ and $CA_4$ now closed and the normally-open contact (a) likewise closed of the control relay RC into the excitation coil 14, whereby the retaining current $I_R$ in place of said discharging current $I_D$ keeps the excitation coil excited to retain the armature 15 in its operative position until the switches $SW_1$ and $SW_2$ are subsequently turned off. When either of the switches $SW_1$ or $SW_2$ is turned off to cease the excitation of the coil 14, said contact sets are returned to the positions shown in FIG. 15, in response to the armature 15 returning into the inoperative position, at which condition the capacitor C is again charged to be ready for the subsequent starting operation. The third and fourth normally-closed auxiliary contact sets $CB_3$ and $CB_4$ are adapted to be connected to a circuit for driving in an interlocked manner with said load an auxiliary load such as an "on-the-running" indicator on the side of said load connected to the first and second load-driving contact sets $CL_1$ and $CL_2$. For this purpose, auxiliary terminals AT are wired respectively to the fixed contacts 4 and 8 of the third and fourth normally-open auxiliary contact sets $CB_3$ and $CB_4$. Numeral 60 indicates an "on-off" indicator located on the side of the switches $SW_1$ and $SW_2$.

Several points in the above circuit undergo functions as shown in FIG. 18A under the normal operating condition. When, for example, the first load-driving contact set $CL_1$ suffers from contact welding during the "on" period X of the switches $SW_1$ and $SW_2$ as shown in FIG. 18B, the second load-driving contact set $CL_2$ connected in series with the first load-driving contact set $CL_1$ can return into open position to safely shut off the load at the subsequent manipulation of turning off the switches $SW_1$ and $SW_2$. Further, at this occurrence, the first control contact set $CC_1$, which has its movable spring coupled by the same card as the first load-driving contact set $CL_1$ suffering from the contact welding, is forced to remain in the open condition so as to prevent the charging circuit from being conductive, thus interrupting the charging of the capacitor, whereby the energization will be no more expected at the time of subsequently turning on the switches. That is, the relay provides a double protection against possible contact welding in the sense of preventing another subsequent load driving operation while leaving the contact failure unfixed in addition to safely interrupting the load in response to turning off the switches. When, for example, the first control contact set $CC_1$ undergoes contact welding during "off" period of the switches $SW_1$ and $SW_2$ as shown in FIG. 18C, the first load-driving contact set $CL_1$ having its movable spring coupled by the same card as the first control contact $CC_1$ suffering from the contact welding will be prevented from acting and remain opened, thus preventing to start the load while leaving the contact failure uncured. With this result, the operator can be immediately informed of the occurrence of contact failure for prompt remedy thereof. Although the above circuit arrangement shows only one application in which the electromagnetic relay of the present invention is adapted to construct a fail-safe circuit for driving the load, the present invention is not limited to the above aspect and can be adapted in use to be incorporated in a variety of circuit arrangement by utilizing the portions or all of the four sets of normally-open contact sets and four sets of normally closed contact sets.

In the above embodiment, the electromagnet device 10 is of a mono-stable construction, however, the electromagnet device may be of bistable construction. Also, there may be used an electromagnet device of general construction not including the permanent magnet in place of the above polarized electromagnet device.

Figure 19:
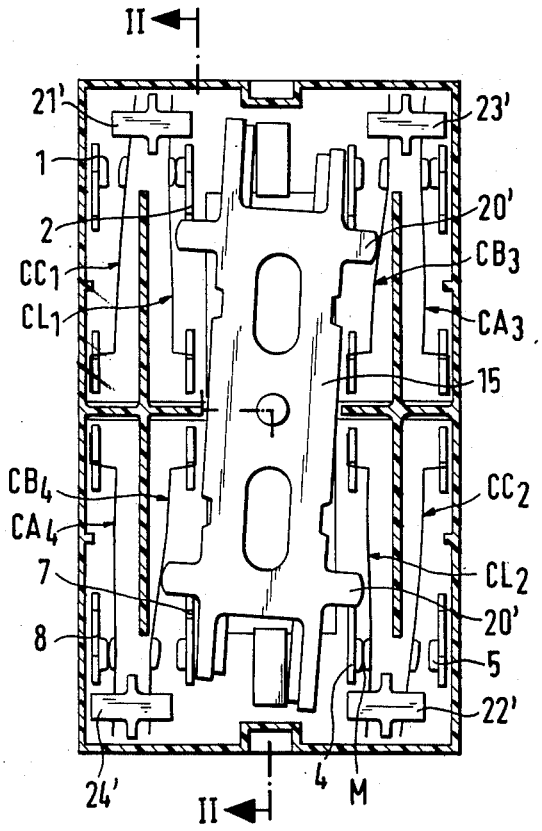
FIG. 19 is a view similar to FIG. 1 of an electromagnetic relay in accordance with a second embodiment of the invention.
Figure 20:
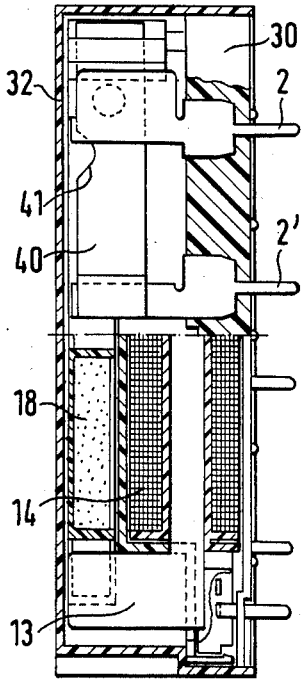
FIG. 20 is a cross-section taken along the line II—II in FIG. 19.

The embodiment of the invention shown in FIGS. 19 and 20 differs from that of FIGS. 1 to 4 in that the coupling members or cards 21', 22', 23', 24' are completely independent of the armature 15 and engage the contact springs 40 at locations close to their outermost free ends beyond the locations where they cooperate with the fixed contacts 1, 2, 3, 4, 5, 6, 7, 8. On the other hand, actuator sections 20' are each adapted for direct engagement with the contact spring 40 of the respective inner contact set at a location spaced from the contact point of that spring to retain a certain amount of flexibility between the point of engagement and the contacting point. Further, the load-driving contact sets $CL_1$, $CL_2$ are assumed to be formed by the inner contact sets whereas the control contact sets $CC_1$, $CC_2$ are formed by the outer contact sets which are more remote from the armature 15. Accordingly, the contact springs 40 of the load-driving contact sets $CL_1$, $CL_2$ are adapted for lift-off type contact opening, and the contact springs 40 of the control contact sets $CC_1$, $CC_2$ are adapted for flexure type contact closing.

In FIG. 19, the monostable relay is shown in its operative condition in which both load-driving contact sets $CL_1$, $CL_2$ are closed and the control contact sets $CC_1$, $CC_2$ are open. In this position of the armature 15, the springs 40 of the load-driving contact sets are disengaged from the respective actuator sections 20'. On the other hand, the auxiliary contact sets $CA_3$, $CA_4$ are closed and the auxiliary contact sets $CB_3$, $CB_4$ are open in the operative position of the armature 15 shown in FIG. 19.

In normal operation of the relay, the switching conditions of all eight contact sets of the relay are reversed when the armature 15 is switched-over to its inoperative condition due to de-energization of the coil 14. However, in case one of the load-driving contact sets, e.g. the set $CL_2$, should become welded in the closed condition as indicated at M in FIG. 19, this load-driving contact set $CL_2$ will not open when the armature 15 returns to its inoperative position. At the same time, the control contact set $CC_2$ will remain open. Nevertheless, the flexibility of the contact spring 40 constituting the load-driving contact set $CL_2$ as well as the dimension and disposition of the corresponding actuator section 20' will permit the armature 15 to pivot back towards its inoperative position to such an extent that the diametrically opposite actuator section 20' will engage the contact spring 40 of the load-driving contact set $CL_1$ and displace this contact spring by an amount sufficient to break this contact set. Simultaneously, the auxiliary contact sets will also be permitted to return to their inoperative positions.

The above-mentioned flexibility in the engagement between the actuator section 20' and the contact spring 40 of the respective load-driving contact set may be increased by providing the contact spring 40 with a lateral cut-out 41 shown in FIG. 20 which reduces the width of the spring to form an area of reduced stiffness at the location of engagement by the actuator section 20'.

An alternative way of achieving a flexible engagement between the armature and the contact spring, not shown in the drawings, would include an actuator portion connected to the armature by a resilient arm rather than being integrally formed with the armature as shown in FIG. 19. Such resiliently connected actuator portions could be in direct engagement with the coupling members or cards.

In the above-described embodiments, the control contact sets $CC_1$, $CC_2$ will indicate contact failure of the associated load-driving contact set not only if the latter undergoes contact welding, but also in case the contact spring 40 of the associated load-driving contact set $CL_1$, $CL_2$ should break. In such a case, the contact spring 40 of the associated control contact set will open due to its inherent bias force irrespective of the position of the armature.

We claim:

1. An electromagnetic relay comprising an excitation coil, an armature adapted for movement in opposite directions between an operative and an inoperative position in response to energization and de-energization of said coil, first and second pairs of contact sets, each pair including a load-driving contact set and a control contact set, each contact set having a fixed contact and a movable contact, the movable contacts of one contact set in each of said first and second pairs being adapted to be positively displaced by said armature against resilient forces when the armature moves in one direction and to return due to said resilient forces when the armature moves in the other direction, and first coupling means ganging the movable contacts of said first pair of contact sets and second coupling means ganging the movable contacts of said second pair of contact sets, each of said coupling means being movable independently of said armature at least when the armature moves from its operative position, in which said load-driving contact sets are closed, to its inoperative position.

2. The relay of claim 1, wherein said control contact sets are closed when said armature is in its inoperative position.

3. The relay of claim 2, wherein the movable contact of each control contact set is biassed towards its open position.

4. The relay of claim 1, wherein each of said movable contacts is formed by a spring which has its one end fixed to a terminal and a portion close to its other end engaged by the respective coupling means.

5. The relay of claim 4, wherein the contact springs of each pair of contact sets extend substantially parallel to each other, each coupling means being formed with a pair of spaced slits for engaging the springs of the respective pair of contact sets.

6. The relay of claim 1, wherein each coupling means is formed by an attuation card biassed by said resilient forces to abut said armature, and each load-driving contact set is arranged for flexure-type contact closure.

7. The relay of claim 1, wherein each load-driving contact set is arranged for lift-off type contact opening and has its movable contact disposed for direct engagement by said armature with such an amount of flexibility that the movability of the armature required to open one load-driving contact set is maintained when the other load-driving set is prevented from opening.

8. The relay of claim 7, wherein the movable contacts of each load-driving contact set is formed by a spring, the armature engaging the spring at a location which is spaced from the part of the spring cooperating with the respective fixed contact.

9. The relay of claim 8, wherein said spring has an area of reduced stiffness at the location of engagement by said armature.

10. The relay of claim 1, wherein said armature is pivotal about an axis extending transversely to said directions of armature movement.

11. The relay of claim 10, wherein said armature is symmetrical with respect to said axis, a total of four pairs of contact sets being located on both sides and at both ends of the armature, with said first and second pairs being disposed diametrically opposite each other.

12. The relay of claim 1, wherein said armature is monostable, being stable, in its inoperative position.

13. The relay of claim 1, including a permanent magnet acting on said armature.

14. An electromagnetic relay comprising:

an excitation coil, an armature adapted for movement in opposite directions between an operative and an inoperative position in response to energization and de-energization of said coil, first and second pairs of contact sets, each pair including a load-driving contact set and a control contact set, each contact set having a fixed contact and a movable contact, the movable contacts of each pair of contact sets being adapted for displacement by said armature against a resilient force when the armature moves in one direction and to be restored due to said resilient force when the armature moves in the other direction, and first coupling means ganging the movable contacts of said first pair of contact sets and second coupling means ganging the movable contacts of said second pair of contact sets, each of said coupling means being movable by the resilient force independently of the respective other coupling means.

* * * * *